US010517793B2

(12) United States Patent
Walden et al.

(10) Patent No.: US 10,517,793 B2
(45) Date of Patent: Dec. 31, 2019

(54) CARDIOPULMONARY COMPRESSION DEVICE RECEIVING FLIP-UP LEGS

(71) Applicant: KONINKLIJKE PHILIPS N.V., Eindhoven (NL)

(72) Inventors: Christopher Walden, Framingham, MA (US); Virginia Higley, Tyngsboro, MA (US); Michael Knipfer, Eindhoven (NL); Ahmed Fouad Said Reda, St. Paul, MN (US); Mark Payne, Eindhoven (NL); John Olson, Eindhoven (NL); Mark Dominguez, Eindhoven (NL); Daniel Burch, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 601 days.

(21) Appl. No.: 15/039,140

(22) PCT Filed: Nov. 3, 2014

(86) PCT No.: PCT/IB2014/065757
§ 371 (c)(1),
(2) Date: May 25, 2016

(87) PCT Pub. No.: WO2015/075592
PCT Pub. Date: May 28, 2015

(65) Prior Publication Data

US 2017/0156979 A1 Jun. 8, 2017

Related U.S. Application Data

(60) Provisional application No. 61/908,238, filed on Nov. 25, 2013.

(51) Int. Cl.
*A61H 31/00* (2006.01)

(52) U.S. Cl.
CPC ..... *A61H 31/008* (2013.01); *A61H 31/006* (2013.01); *A61H 2201/0107* (2013.01);
(Continued)

(58) Field of Classification Search
CPC ..... A61H 31/008; A61H 31/006; A61H 2201/0107; A61H 2201/0161;
(Continued)

(56) References Cited

U.S. PATENT DOCUMENTS 3,489,140 A * 1/1970 Mullikin ..... A61H 31/006 601/41
3,650,578 A * 3/1972 Del Vecchio ..... A47B 88/493 312/334.46
(Continued)

FOREIGN PATENT DOCUMENTS

CA 202654386 U 1/2013
CN 201245087 Y 5/2009
(Continued)

OTHER PUBLICATIONS

English Translation of SE 396692—Bucur (Year: 1977).*

*Primary Examiner* — Quang D Thanh

(57) ABSTRACT

A cardio-pulmonary compression board includes a board (10) configured for a patient. A leg (20) is pivotally connected to the board, and the leg includes a free end portion having a mechanical feature (35) configured to be received in a compression device to adjustably secure the compression device at a distance from the board in an operational position. A locking mechanism (32, 42) is configured to releasably maintain the leg in the operational position, which is transverse to a plane of the board.

20 Claims, 8 Drawing Sheets

(52) U.S. Cl.
CPC ..... *A61H 2201/0157* (2013.01); *A61H 2201/0161* (2013.01); *A61H 2201/1619* (2013.01); *A61H 2203/0456* (2013.01); *A61H 2205/084* (2013.01)

(58) Field of Classification Search
CPC ..... A61H 2201/149; A61H 2201/5064; A61H 2201/5061; A61H 2201/1215; A61H 2201/0157; A61H 2201/50
See application file for complete search history.

(56) References Cited

U.S. PATENT DOCUMENTS

| | | | | |
|---|---|---|---|---|
| 3,782,371 | A * | 1/1974 | Derouineau | A61H 31/007 601/105 |
| 4,632,094 | A | 12/1986 | Thomas | |
| 5,399,148 | A * | 3/1995 | Waide | A61H 31/00 601/106 |
| 5,595,410 | A | 1/1997 | Wilson et al. | |
| 5,823,185 | A | 10/1998 | Chang | |
| 7,214,203 | B2 | 5/2007 | Hwang | |
| 2008/0097257 | A1* | 4/2008 | Stromsnes | A61H 31/00 601/41 |
| 2008/0097261 | A1* | 4/2008 | Hansen | A61H 31/00 601/107 |
| 2010/0113990 | A1 | 5/2010 | Chang | |
| 2010/0185127 | A1* | 7/2010 | Nilsson | A61H 31/004 601/41 |
| 2010/0198118 | A1* | 8/2010 | Itnati | A61H 31/004 601/41 |
| 2012/0238922 | A1* | 9/2012 | Stemple | A61H 31/006 601/41 |
| 2014/0143986 | A1* | 5/2014 | Genova | A01K 27/005 24/369 |
| 2014/0221883 | A1* | 8/2014 | Jeppsson | A61H 31/006 601/41 |
| 2015/0119768 | A1* | 4/2015 | Meier | A61H 31/006 601/41 |
| 2015/0359705 | A1* | 12/2015 | Paulussen | A61H 31/006 601/41 |

FOREIGN PATENT DOCUMENTS

| | | | |
|---|---|---|---|
| CN | 103040602 | A | 4/2013 |
| CN | 203005354 | U | 6/2013 |
| FR | 1331573 | A | 7/1963 |
| JP | S59105128 | U | 7/1984 |
| JP | H04254010 | A | 9/1992 |
| JP | 2000024069 | A | 1/2000 |
| SE | 396692 | B | 10/1977 |
| WO | 2010119401 | A1 | 10/2010 |

* cited by examiner

CARDIOPULMONARY COMPRESSION DEVICE RECEIVING FLIP-UP LEGS

This application is a national stage application under 35 U.S.C. § 371 of International Application No. PCT/IB2014/065757 filed on Nov. 3, 2014 and published in the English language on May 28, 2015 as International Publication No. WO/2015/075592, which claims priority to U.S. Application No. 61/908,238 filed on Nov. 25, 2013, the entire disclosures of which are incorporated herein by reference.

BACKGROUND

Technical Field

This disclosure relates to cardiopulmonary instruments and more particularly to methods and devices for automatic cardiopulmonary resuscitation (CPR) systems.

Description of the Related Art

Mechanical cardiopulmonary resuscitation (CPR) compression devices provide many clinical and practical advantages over manual CPR. Per 2010 guidelines from the American Heart Association (AHA), the CPR compression rate should be at least 100 compressions per minute with a depth of at least 5 centimeters (for adults). Studies have found that manual CPR is frequently performed too slowly and without adequate depth to ensure good perfusion. In addition, even if manual compressions are performed to AHA guidelines, caregivers tire quickly. Mechanical CPR devices provide compressions consistent with AHA guidelines over long periods of time.

To avoid pre-loading of the chest and to provide clearance for electrodes or other devices, some mechanical CPR devices provide an elevation feature for a compression unit to enable the compression unit to be supported above a patient's chest. For ease and speed of application on the patient, the suspended compression unit is usually stored as a separate component from a rigid backboard, and they are connected together after the patient has been placed on top of the backboard. During therapy, as the compression force pushes against the patient's chest, the equal and opposite reaction force must be transmitted through the mechanical interface between the compression unit and the backboard.

To accommodate the range of possible patient sizes, this rigid support mechanism must also provide a height adjustment method to position the compression pad on the patient's chest. In systems where the compression unit can clear larger patients, an extended vertical plunger may be employed to contact a smaller patient's chest. This design results in a fixed, relatively high center of gravity for the compression unit, which can adversely affect the device's stability during operation and transport. This can also contribute to rocking of the compression device, or even movement of the plunger on the patient's chest. This may adversely affect therapy and/or make it more difficult for the caregivers to operate. Even for very small patients, the device's overall height is fixed, which caregivers must deal with and maneuver around, regardless of patient size.

In some designs, the caregiver must lift the compression unit above the patient, position it, and then work to mate the compression device with the underlying backboard. With such designs, adipose tissue of very large and obese patients can obstruct and delay the connection of the compression unit to the backboard. In other cases, the patient's clothing and even the underlying bed sheets can interfere and obstruct the fast attachment of the compression unit to the backboard. Either scenario can increase the time needed to set up the system and start compressions, and every second counts when the patient has suffered sudden cardiac arrest.

SUMMARY

In accordance with the present principles, a cardio-pulmonary compression board includes a board configured for a patient. One or more legs are pivotally connected to the board, and the leg(s) include a free end portion having a mechanical feature configured to be received in a compression device to adjustably secure the compression device at a distance from the board in an operational position. A locking mechanism is configured to releasably maintain the leg(s) in the operational position, which is transverse to a plane of the board.

A cardio-pulmonary compression system includes a board configured for a patient and at least one leg pivotally connected to the board, the at least one leg including a free end portion having a mechanical feature. A compression device is configured to receive the free end portion of the at least one leg and engage the mechanical feature to adjustably secure the compression device at a distance from the board in an operational position. A locking mechanism is configured to releasably maintain the at least one leg in the operational position, which is transverse to a plane of the board.

A method for positioning a compression device includes providing a board having at least one leg pivotally connected to the board, the at least one leg including a free end portion having a mechanical feature configured to be received in a compression device to adjustably secure the compression device at a distance from the board in an operational position; adjusting the at least one leg to the operational position; locking the at least one leg in the operational position transversely to a plane of the board; receiving the at least one leg in the compression device; and adjusting a position of the compression device using the mechanical feature.

These and other objects, features and advantages of the present disclosure will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF EMBODIMENTS

Figure 1:
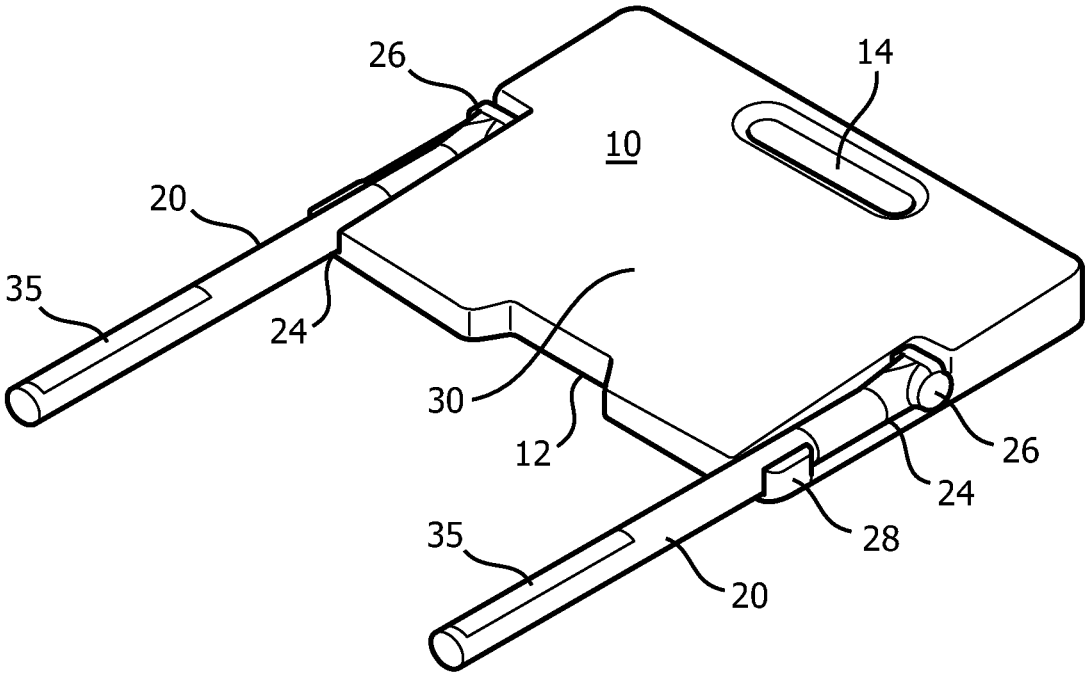
FIG. 1 is a perspective view showing a compression board having adjustable legs in accordance with one embodiment.

In accordance with the present principles, a compression system includes a retractable leg or legs that retract into or adjacent to a rigid backboard. The compression system includes a compression board, which is configured to be placed underneath a patient's back, and a compression unit, which can be suspended over a patient and mates with the retractable legs. The compression unit is supported by one or two legs which are attached to the compression board. These legs rotate between a storage position where the legs are parallel to the plane of the compression board, and an operational position where the legs are upright and transverse (e.g., approximately perpendicular) to the compression board. This configuration provides a number of usability advantages. The legs are attached to the compression board, rather than the compression unit. After the compression board is positioned underneath the patient, the legs are rotated upward to their vertical, locked position. The rotation of the legs permits the legs to slide past the sides of larger patients. They will also slide past the patient's clothing, bed sheets, etc.

The compression unit may include openings configured to receive the legs. The compression unit slides down onto upper portions of the legs, engaging the legs well above and away from anything that could interfere with the connection between the compression unit and the legs. As a result, a caregiver does not need to manually lift and/or push the patient's adipose tissue, clothing, or bed sheets aside to mate the compression unit with the compression board. They will not need to search for clearance or a clear line of sight for a proper connection to be made. The present principles reduce setup time, reduce margin for error in these cases and thereby shorten the time to therapy where seconds count when the patient has suffered sudden cardiac arrest. In addition, unlike conventional designs, since the compression unit does not have legs attached to it, the compression unit is less bulky, more balanced, and easier to maneuver into position than devices which have their extensions integrally connected to the compression unit. This reduces delay time for initiation of therapy.

It should be understood that the present invention will be described in terms of medical instruments; however, the teachings of the present invention are much broader and are applicable to training equipment, and any other instrument that employs automatic compressions. In some embodiments, the present principles are employed in providing compressions for complex biological or mechanical systems.

The elements depicted in the FIGS. may be implemented in various combinations of hardware and software and provide functions which may be combined in a single element or multiple elements.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

Referring now to the drawings in which like numerals represent the same or similar elements and initially to FIG. 1, a compression board 10 having retracted legs 20 is shown in accordance with one illustrative embodiment. The compression board 10 may include a rigid material including but not limited to metal, plastic or other suitable materials. The compression board 10 may have one or more recesses 12, handles 14, or other features to facilitate carrying and/or installation and/or positional adjustment underneath a patient during operation. The compression board 10 includes one or more legs 20 pivotally connected to the compression board 10. A cross-sectional profile of these legs 20 may be circular or may include any other geometry (e.g., oval, polygonal, etc.).

The legs 20 rotate about a connection point 26 to the compression board 10. If there are two legs 20, they may be interconnected to one another, so that they rotate together, or they may rotate independently of one another. In a horizontal storage position within recesses 24, a retention mechanism 28, such as a clip, ball plunger/detent, or other device may be incorporated to hold the legs 20 in position. In some embodiments, the legs 20 may be telescoping or nested to permit efficient storage. For example, each leg 20 may include two concentric tubes (cylindrical or other shape). Upon deployment, an inner or outer tube (whichever one is not affixed to pivot point 26) slides out and snaps into a fully-extended position. Other configurations are also contemplated.

The legs 20 include mechanical or locking features 35 on an upper portion thereof. The locking features 35 are configured to detachably receive and secure a compression unit as will be described hereinbelow. The locking features 35 may include surface features on the legs 20. These surface features may include a knurled surface, a finely grooved surface, a smooth surface or a rough surface finish. Any number of non-smooth finishes or features may be employed alone or in combination.

Figure 2A:
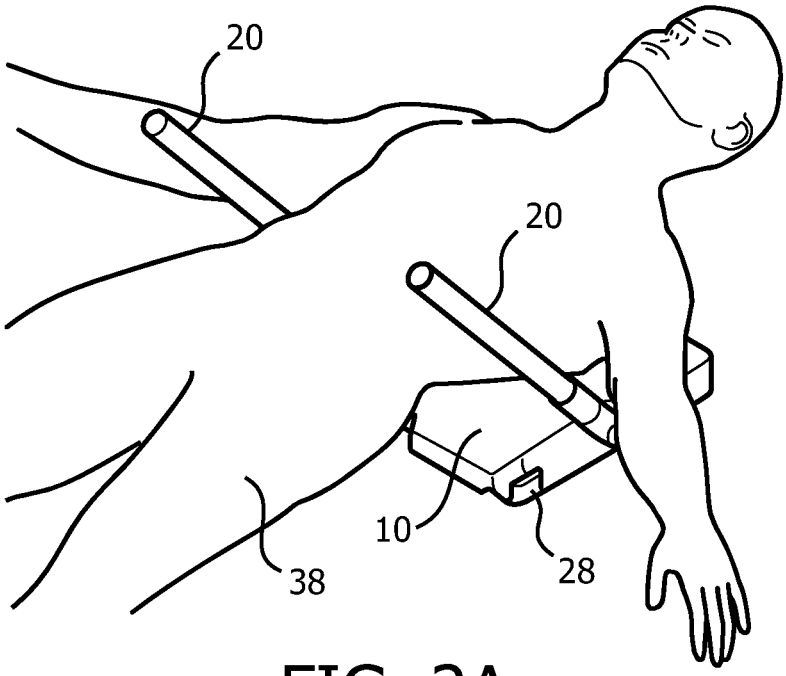
FIG. 2A is a perspective view showing the compression board having the legs adjusted to an intermediary position in accordance with one embodiment.
Figure 2B:
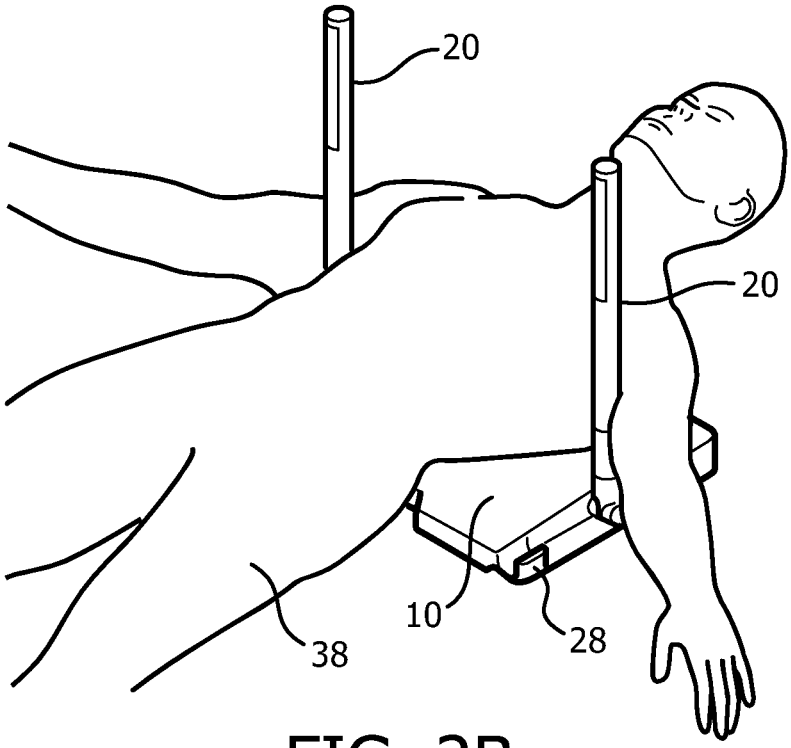
FIG. 2B is a perspective view showing the compression board having the legs adjusted to an operational position in accordance with one embodiment.

Referring to FIGS. 2A and 2B, a person or patient 38 is depicted lying on the compression board 10. In FIG. 2A, the legs 20 are released and rotated upward. In FIG. 2B, the legs 20 are locked in an operational position such that they are approximately perpendicular to the compression board 10. The legs 20 are able to positively be latched in this position using a mechanism internal to the compression board 10 although the mechanism may be external to the board 10 as well (e.g., latches, etc.). When desired, these latches may be released to again return the legs 20 to the storage position.

Figure 3:
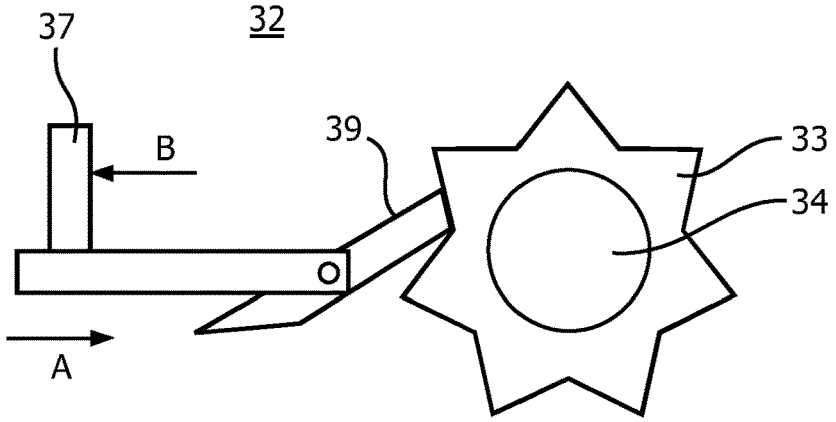
FIG. 3 is a side schematic view showing an illustrative internal locking mechanism to be disposed within the compression board in accordance with one embodiment.

Referring to FIG. 3, an internal locking mechanism 32 is illustratively shown. The mechanism 32 includes a shaped flange 33 that is attached to a shaft 34. The shaft 34 is coupled to the legs 20 (not shown) and rotates with the legs 20 as the legs 20 rotate about the pivot point 26 (FIG. 1). The mechanism 32 includes a lock 39 that engages the flange 33. The lock 39 is biased in the direction of arrow "A". A release toggle 37 is employed to move the lock 39 in the direction of arrow "B" to release the lock 39 and the flange 33 to permit the flange 33 (and legs 20) to be moved to the storage position. When the legs 20 are to be moved to the operational position, the flange 33 rotates against the lock 39 until a stop is hit in the fully deployed position (FIG. 2B). After use, the release toggle 37 is employed to release the flange 33. It should be understood that the internal mechanism 32 is illustrative as other mechanisms, internal or external, may be employed to secure the legs, together or individually, as needed. For example, the flange 33 and lock 39 may include or be replaced by gears, a rack and pinion, etc.

Figure 4:
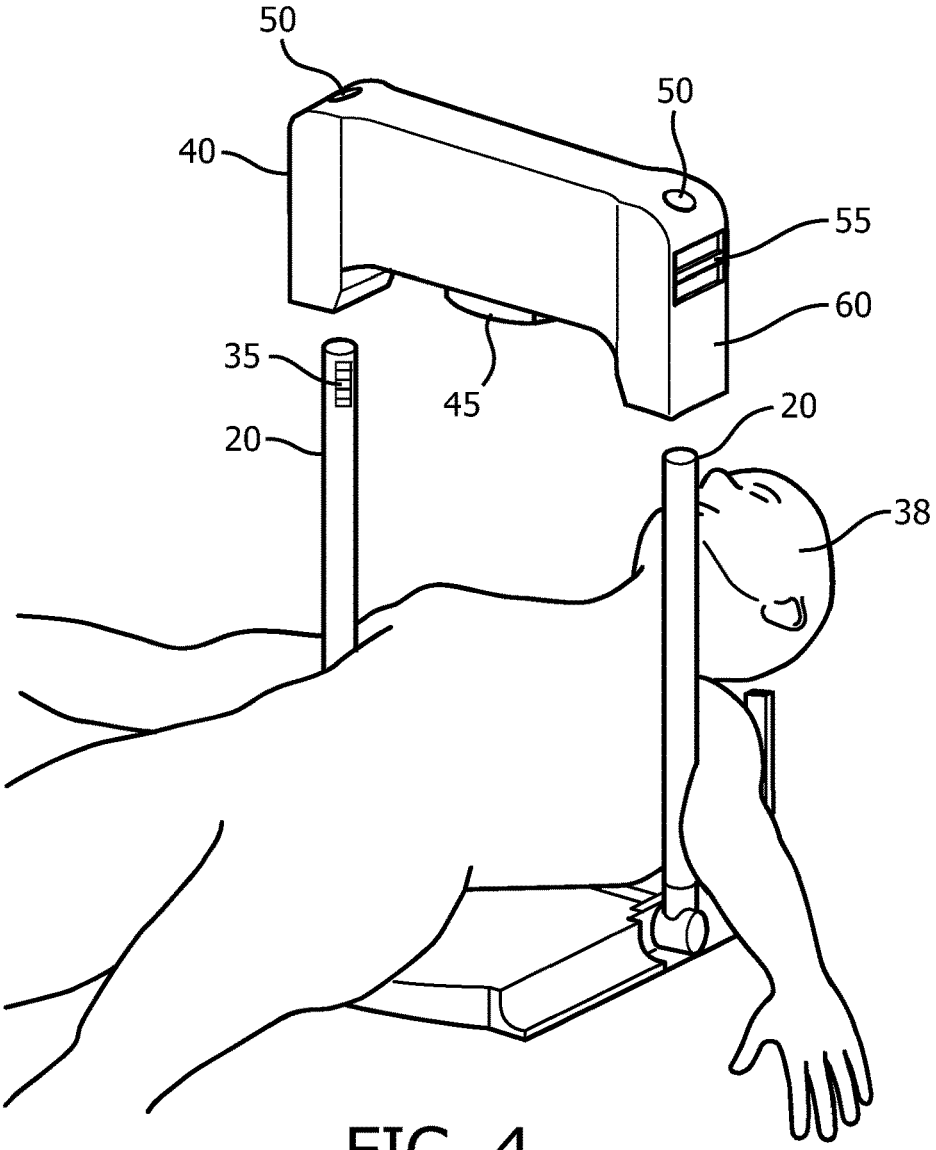
FIG. 4 is a perspective view showing the compression board legs receiving a compression device through holes formed therein in accordance with one embodiment.

Referring to FIG. 4, a powered compression unit 40 includes a pad assembly 45, which applies chest compressions to the patient 38. The compression unit 40 may be electrically or pneumatically powered to provide compressions. During setup on the patient 38, the compression unit 40 is slid down onto the vertical legs 20. Each leg 20 slides through an opening 50 in the compression unit 40. Openings 50 may include holes or openings on the side not fully enclosing outside surfaces of the legs 20 or other configurations for receiving the legs 20. Mechanisms inside the compression unit 40 fasten the compression unit 40 to the legs 20. One or more control buttons or handles 55 allow the caregiver to manually latch and/or release these fastening mechanisms 60, allowing the caregiver to control the height of the compression unit 40 on the legs 20. A number of different types of mechanisms may be employed to fasten the compression unit 40 to the legs 20. Examples follow.

Figure 5:
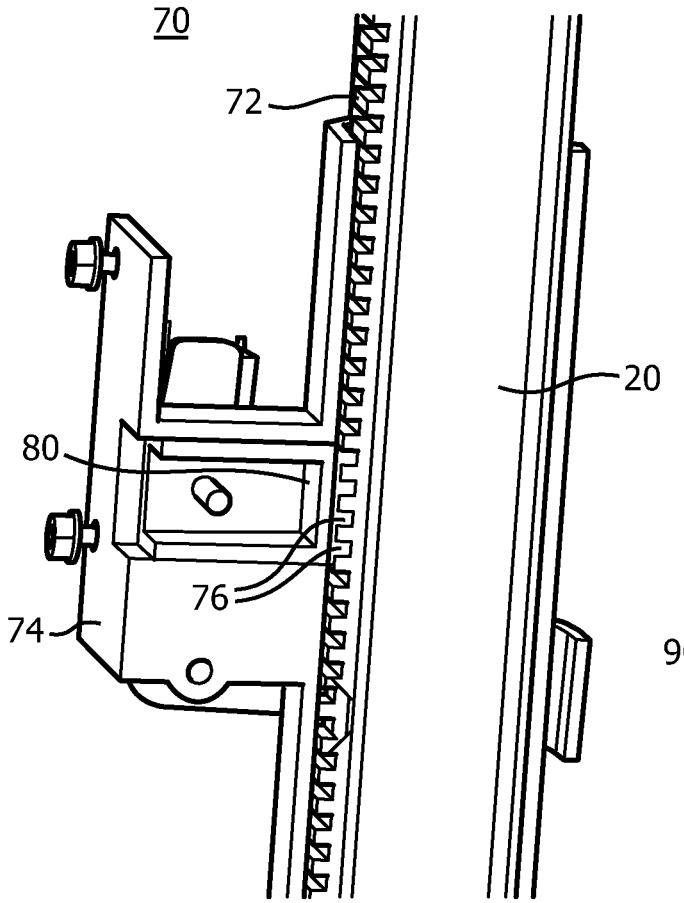
FIG. 5 is a perspective view showing a mechanical feature for locking the compression device on the compression board legs including mating teeth in accordance with one embodiment.

Referring to FIG. 5, one embodiment to fasten the compression unit to the leg 20 includes a rack lock mechanism 70. The legs 20 include rigid racks 72 with rack-like teeth, ridges, or screw threads on them. Inside the compression unit 40, a mechanism 74 has a corresponding set of rigid mating teeth 76, which may be engaged or disengaged from the teeth 72 on the legs 20. This may be done by a rotating pinion (not shown), whose rotation can be latched or released, and/or by a section of straight rack 80, which may be slid and/or rotated to/from an engaged position with the teeth 72 on the leg 20.

Figure 6:
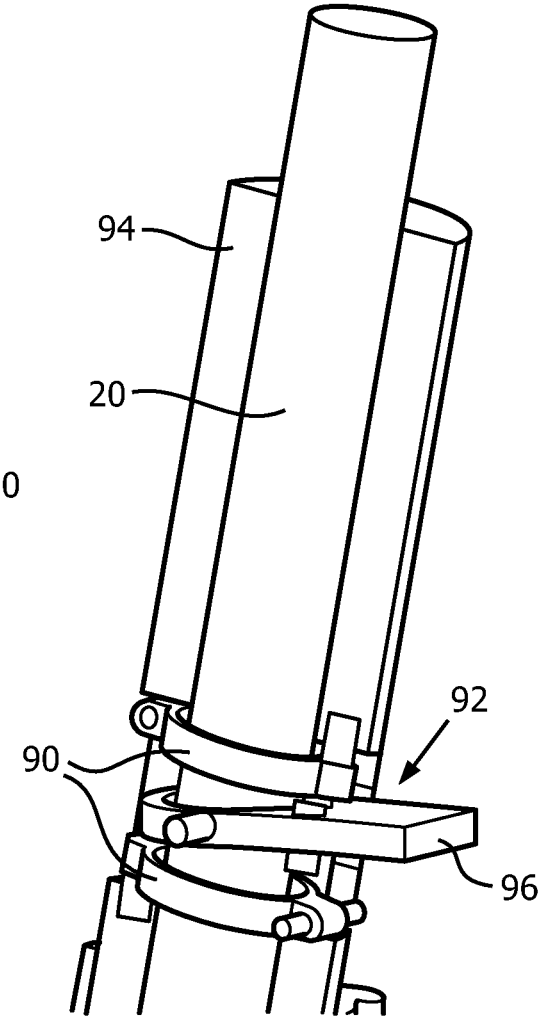
FIG. 6 is a perspective view showing a mechanical feature for locking the compression device on the compression board legs including friction rings in accordance with another embodiment.

Referring to FIG. 6, another embodiment for coupling the legs 20 to the compression unit 40 may include a fastening mechanism 92, which is composed of one or more rigid rings 90 (friction rings) in the compression unit 40 surrounding the leg 20. In the locked position, the rings 90 are oriented at an angle with respect to the legs 40, so that the internal corners of the rings 90 are forced against an outside surface of the legs 20. The resulting high friction or binding force between the rings 90 and the legs 20 holds the compression unit 40 in place. The compression unit 40 is connected with a sleeve 94, which is formed in or through the openings or holes 50 in the compression unit 40. Rotating or moving the rings 90 using a lever 96 or other device moves the rings 90 to be more perpendicular to the legs 20 to eliminate the interference and enable free movement of the compression unit 40 with respect to the legs 20.

Figure 7:
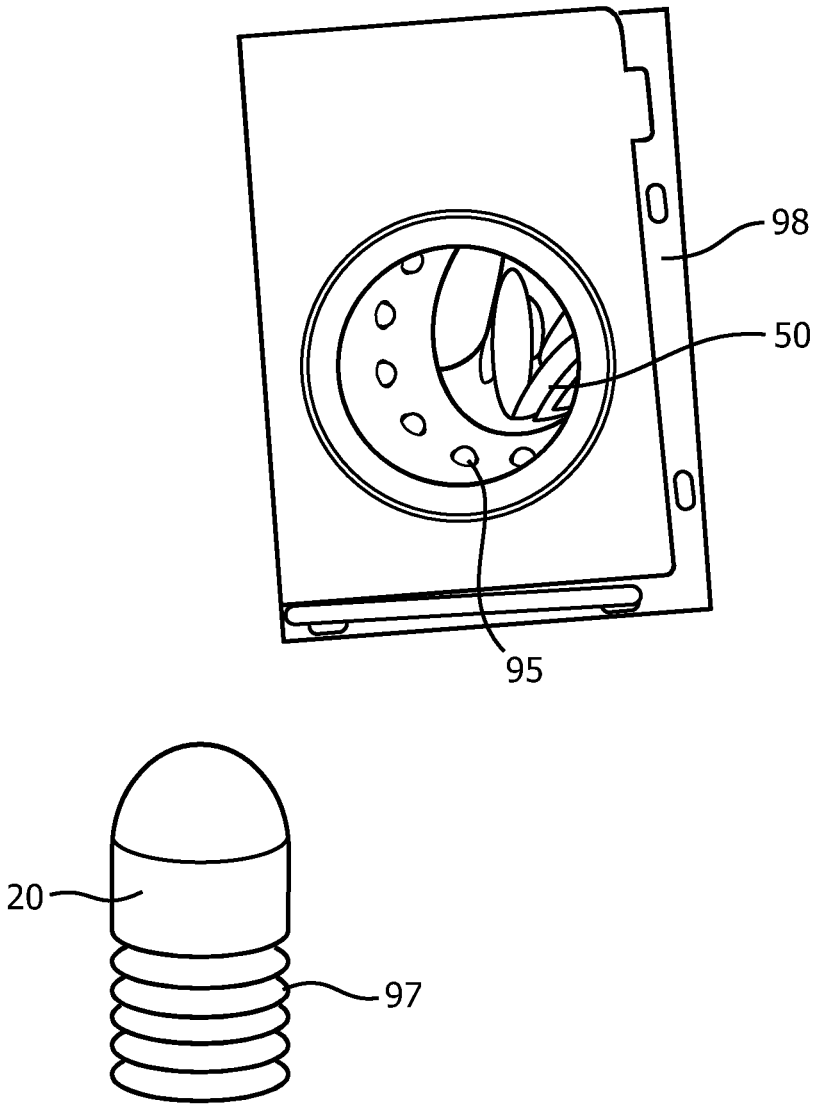
FIG. 7 is a perspective view showing a mechanical feature for locking the compression device on the compression board legs including retractable bearings in accordance with another embodiment.

Referring to FIG. 7, another embodiment includes a variation of the rack lock embodiment described in FIG. 5. Captive retractable bearings 95 (e.g., metal balls or cylindrical rollers) are provided in the openings or holes 50 in the compression unit 40. Mating grooves 97 are formed in the legs 20. A mechanism 98 in the compression unit 40 holds the bearings 95 in a fixed, engaged position with the grooves 97 in the legs 20, or allows the balls/rollers of the bearings 95 to move out of the grooves 97 to enable relative movement between the compression unit 40 and the legs 20. Grooves 97 may include a spiral configuration or other configurations, e.g., the groove 97 may include segments or pits that receive the retractable bearings 95 therein. Once the bearings 95 are seated in the grooves the bearings 95 engage and hold the mechanism 98 (compression unit 40) in position on the legs 20.

It should be understood that other mechanisms may be employed in addition to or instead of those described. For example, the legs 20 may include a plurality of holes or detents with corresponding protrusions or pins for the compression unit 40 being received therein.

Figure 8:
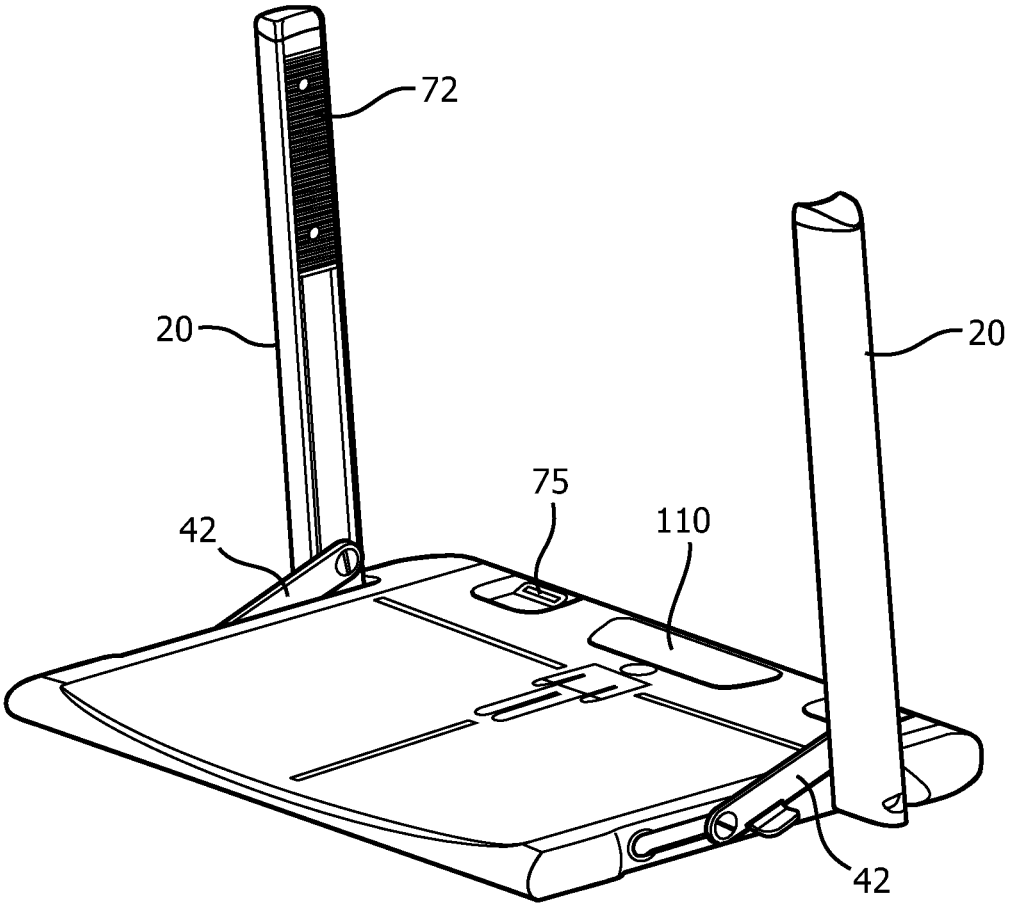
FIG. 8 is a perspective view of another compression board having pivoting legs secured by an external locking mechanism in accordance with another embodiment.

Referring to FIG. 8, another compression board 110 is illustratively shown. The board 110 may incorporate one or more features for preventing head-to-toe movement of the patient with respect to it. One embodiment incorporates fastening points 75 on the compression board where straps could be attached, which in turn would be placed against the patient's shoulders, and the other end of the straps would be attached to either the compression unit (40) and/or the upright legs 20. Here, the legs 20 include rack teeth 72 at upper portions of the legs 20. The legs 20 are supported in an upright position by an external locking mechanism or latch 42. Other securing mechanisms may include a ratchet-like mechanism, gears, etc. which may be located internally or externally to the board 110.

Figure 9:
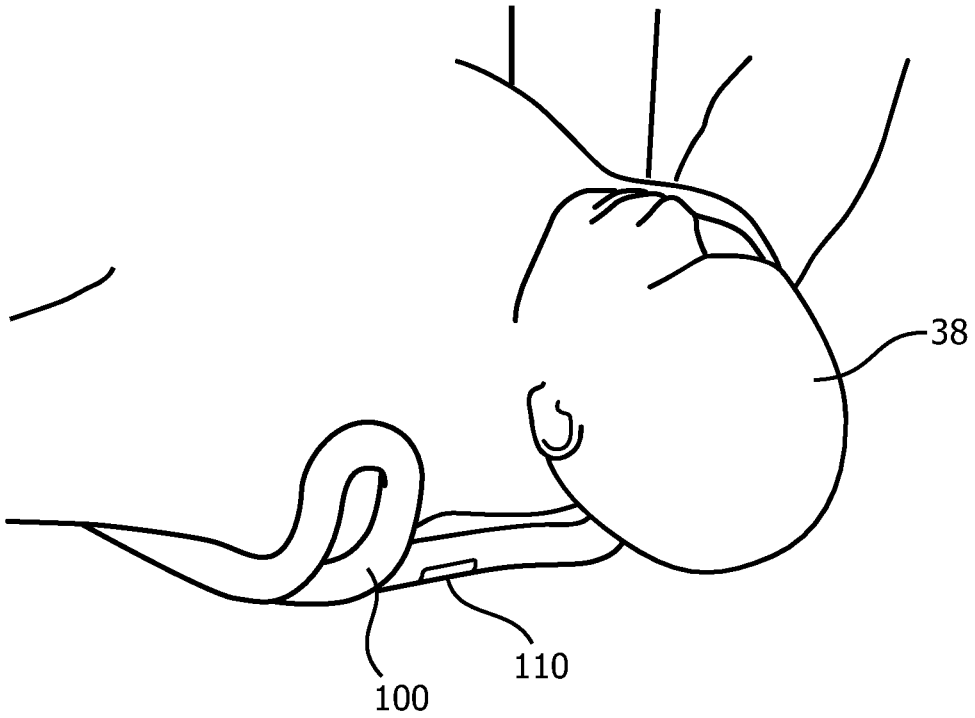
FIG. 9 is a perspective view showing a shoulder stop feature in accordance with one embodiment.

Referring to FIG. 9, another embodiment for preventing head-to-toe movement of the patient incorporates a rigid shoulder stop or stops 100 mounted on or in into the compression board 10. The shoulder stops 100 may be fixed position, or their position and/or orientation may be adjustable to accommodate patients of different sizes. The shoulder stops 100 may fold up or down or otherwise stow away to facilitate storage. In one embodiment, the shoulder stops 100 may be removable.

Figure 10:
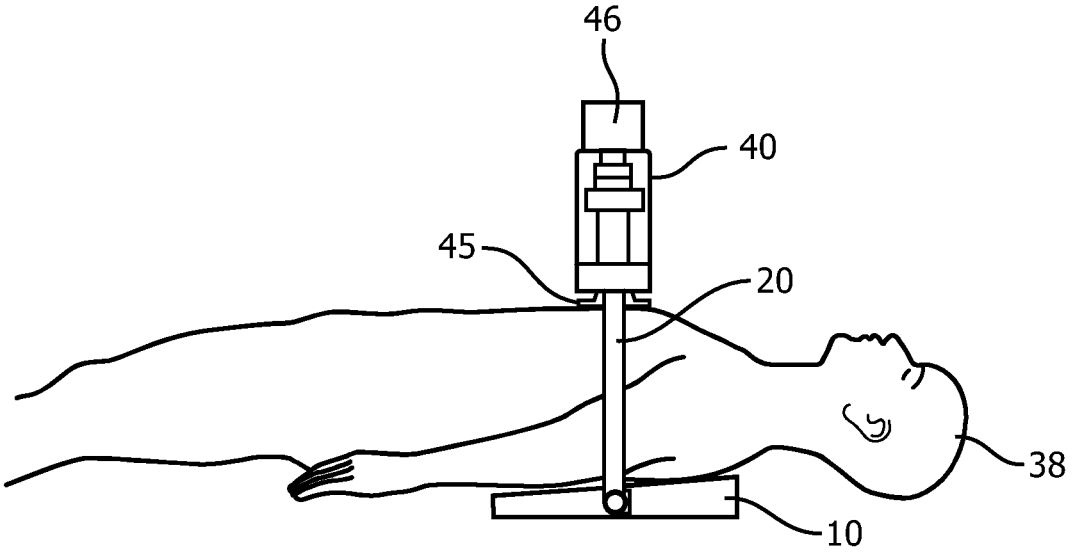
FIG. 10 is a side perspective view showing a compression board having pivoting legs and a compression device in operational position in accordance with one embodiment.

Referring to FIG. 10, an assembled setup for applying automated compressions to a patient 38 is illustratively shown. The compression board 10 with legs 20 in the storage position has been placed underneath the patient's back.

Once the patient 38 is on the compression board 10, the legs 20 are rotated upward. In the case of a very large patient, the legs 20 will slide past the sides of the patient 38. The legs 20 are latched into the vertical operational position, as shown. The compression unit 40 is slid down onto the upright legs 20. The caregiver does not need to search or move the patient's flesh, bed sheets or other obstructions near or at the level of the board 10 out of the way to connect the compression unit 40 to the compression board 10. With the compression unit's pad assembly 45 resting against the patient's chest, automated chest compressions may begin.

To help make it easier for the caregiver to move the compression unit 40 up and down on the legs 20, as well as limit the weight load sitting upon the patient's chest, the compression unit 40 may incorporate one or more counterweight mechanisms 46 to help support its weight as it slides up and down the legs 20. Some combination of constant force springs, spring motors, extension or compression springs, or other means may be employed to limit the weight load of the compression unit 40 on the patient 38.

Figure 11:
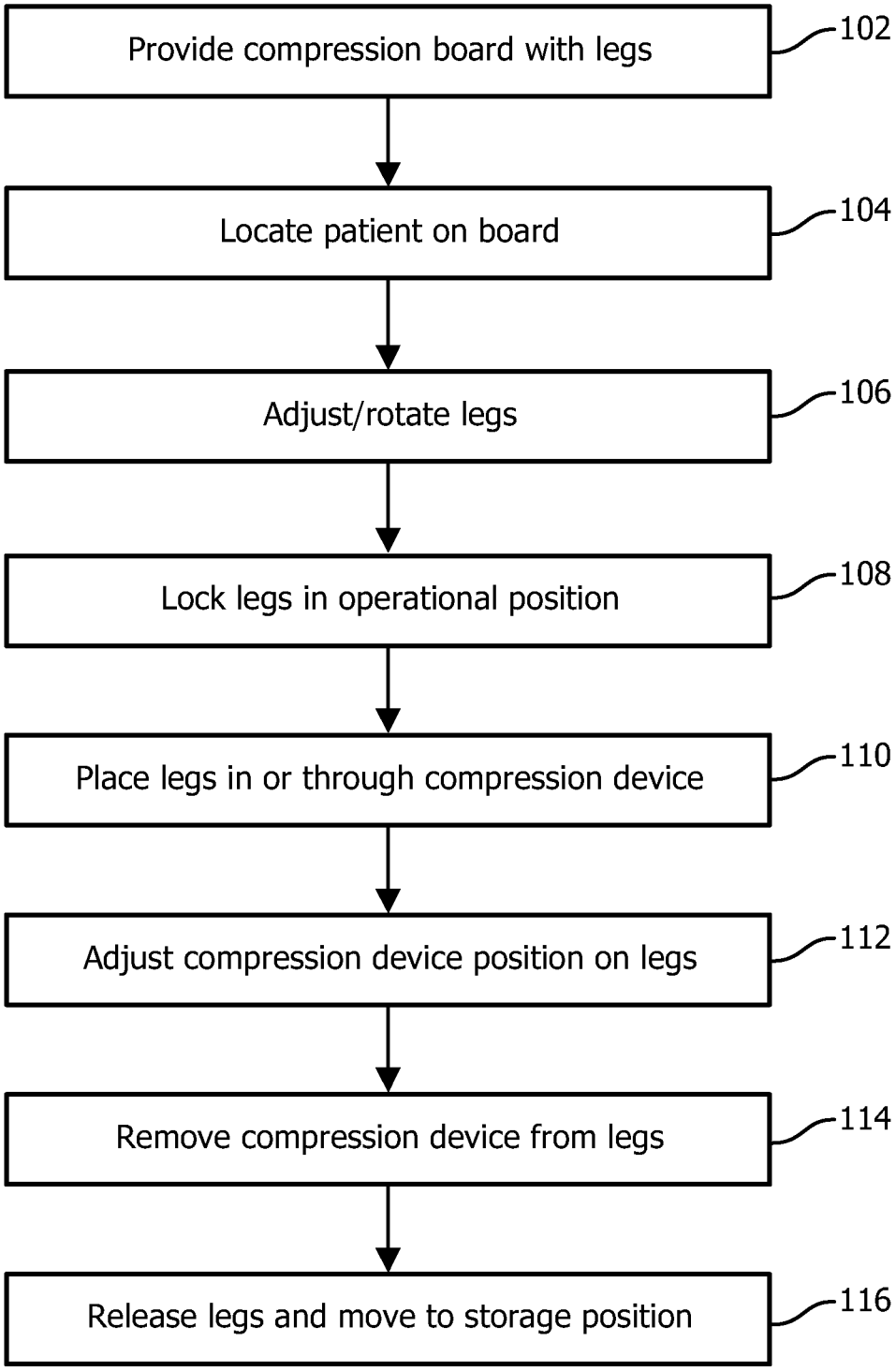
FIG. 11 is a flow diagram showing a method for positioning a compression device for a cardio-pulmonary compression system in accordance with an illustrative embodiment.

Referring to FIG. 11, a method for positioning a compression device for dynamic adjustment of a cardio-pulmonary compression system is shown in accordance with illustrative embodiments. In block 102, a board (compression board) is provided having at least one leg pivotally connected to the board. The leg(s) includes a free end portion having a mechanical feature configured to be received in a compression device to adjustably secure the compression device at a distance from the board in an operational position. In block 104, a patient is placed over the board with the leg or legs on sides of the patient. The board may be previously placed, e.g., the board may be located in or on or built in or on a gurney or in a hospital bed. In block 106, the at least one leg is adjusted to the operational position. This may include releasing the leg or legs from a storage position and rotating the legs to the operational position. In this way the lower connection behind the patient is pre-made and the user does not have to search the bed, board, etc. behind the patient to find a connection point.

In block 108, the at least one leg may be locked in the operational position, which is transverse to a plane of the board. In block 110, the at least one leg is received in the compression device. The at least one leg may be received in at least one hole in the compression device wherein the compression device includes a mating mechanical feature to the mechanical feature on the at least one leg. The mechanical feature(s) may include corresponding teeth, friction rings, retractable bearings, etc.

In block 112, the position of the compression device is adjusted along the leg(s) using the mechanical feature. Adjusting the position of the compression device may include adjusting the distance of the compression device to contact the patient without a preload force on the patient. The distance may also be backed off so that the compression device is out of the way to permit access to the patient's chest or provide working space over the patient.

After compression therapy, the compression device is removed from the leg(s) by releasing the mechanical feature in block 114. In block 116, the at least one leg may be released to return the at least one leg to a storage position.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function; and e) no specific sequence of acts is intended to be required unless specifically indicated.

Having described preferred embodiments for cardiopulmonary compression device receiving flip-up legs (which are intended to be illustrative and not limiting), it is noted that modifications and variations can be made by persons skilled in the art in light of the above teachings. It is therefore to be understood that changes may be made in the particular embodiments of the disclosure disclosed which are within the scope of the embodiments disclosed herein as outlined by the appended claims. Having thus described the details and particularity required by the patent laws, what is claimed and desired protected by Letters Patent is set forth in the appended claims.

The invention claimed is:

1. A cardio-pulmonary compression board, comprising:

a board configured for a patient;

at least one leg pivotally connected to the board to pivot along sides of a patient region on the board, the at least one leg including a free end portion having a mechanical feature configured to be received in a compression device to adjustably secure the compression device at a vertical distance from the board in an operational position; and a locking mechanism configured to releasably maintain the at least one leg in the operational position, which is transverse to a plane of the board.

2. The board as recited in claim 1, wherein the at least one leg includes two legs disposed on end portions of the board such that a patient lying on the board is disposed between the legs in the operational position.

3. The board as recited in claim 1, wherein the board includes a retention mechanism to secure the at least one leg in a storage position.

4. The board as recited in claim 1, wherein the locking mechanism is disposed internally to the board.

5. The board as recited in claim 4, wherein the locking mechanism includes a shaped flange which locks the at least one leg in the operational position and includes a release to restore the at least one leg to a storage position.

6. The board as recited in claim 1, wherein the locking mechanism is disposed externally to the board.

7. The board as recited in claim 6, wherein the locking mechanism includes a latch which locks the at least one leg in the operational position and is releasable to restore the at least one leg to a storage position.

8. The board as recited in claim 1, wherein the mechanical feature configured to be received in the compression device includes teeth configured to engage teeth provided in the compression device.

9. The board as recited in claim 1, wherein the mechanical feature includes a surface of the at least one leg and further including rings configured to engage and hold the at least one leg in a first position and configured to disengage the at least one leg in a second position.

10. The board as recited in claim 1, wherein the mechanical feature configured to be received in the compression device includes a surface configured to receive retractable bearing elements therein, which are configured hold the at least one leg in a first position and configured to disengage the at least one leg in a second position.

11. A cardio-pulmonary compression system, comprising:

a board configured for a patient;

at least one leg pivotally connected to the board to pivot along sides of a patient region on the board, the at least one leg including a free end portion having a mechanical feature;

a compression device configured to receive the free end portion of the at least one leg and engage the mechanical feature to adjustably secure the compression device at a vertical distance from the board in an operational position; and a locking mechanism configured to releasably maintain the at least one leg in the operational position, which is transverse to a plane of the board.

12. The board as recited in claim 11, wherein the at least one leg includes two legs disposed on end portions of the board such that a patient lying on the board is disposed between the legs in the operational position, wherein the board includes a retention mechanism to secure the legs in a storage position.

13. The board as recited in claim 11, wherein the locking mechanism is disposed internally to the board and includes a shaped flange which locks the at least one leg in the operational position and includes a release to restore the at least one leg to a storage position.

14. The board as recited in claim 11, wherein the locking mechanism is disposed externally to the board and includes a latch which locks the at least one leg in the operational position and is releasable to restore the at least one leg to a storage position.

15. The board as recited in claim 11, wherein the mechanical feature configured to be received in the compression device includes at least one of: teeth configured to engage teeth provided in the compression device; a surface of the at least one leg and adjustably secured by rings in the compression device configured to engage and hold the at least one leg in a first position and configured to disengage the at least one leg in a second position; or a surface configured to receive retractable bearing elements in the compression device which are configured hold the at least one leg in a first position and configured to disengage the at least one leg in a second position.

16. A method for positioning a compression device, comprising:

providing a board having at least one leg pivotally connected to the board to pivot along sides of a patient region on the board, the at least one leg including a free end portion having a mechanical feature configured to be received in a compression device to adjustably secure the compression device at a vertical distance from the board in an operational position;

adjusting the at least one leg to the operational position;

locking the at least one leg in the operational position transversely to a plane of the board;

receiving the at least one leg in the compression device; and adjusting a position of the compression device using the mechanical feature.

17. The method as recited in claim 16, wherein adjusting the position includes adjusting the distance of the compression device to one of: contact a patient with a reduced or eliminated force on the patient, or back off the compression device to access the patient.

18. The method as recited in claim 16, further comprising releasing the at least one leg to return the at least one leg to a storage position.

19. The method as recited in claim 16, wherein receiving the at least one leg in the compression device includes receiving the at least one leg in at least one opening in the compression device wherein the compression device includes a mating mechanical feature to the mechanical feature on the at least one leg.

20. The method as recited in claim 16, wherein the mechanical feature includes at least one of: corresponding teeth, friction rings or retractable bearings.

* * * * *